US007661286B2

(12) United States Patent
Warmbrunn

(10) Patent No.: US 7,661,286 B2
(45) Date of Patent: Feb. 16, 2010

(54) METHOD FOR PRODUCING A CUP-SHAPED OBJECT

(75) Inventor: Klaus Warmbrunn, Braunschweig (DE)

(73) Assignee: Maiko Engineering GmbH, Braunschweig (DE)

( * ) Notice: Subject to any disclaimer, the term of this patent is extended or adjusted under 35 U.S.C. 154(b) by 0 days.

(21) Appl. No.: 10/570,356

(22) PCT Filed: Sep. 2, 2004

(86) PCT No.: PCT/DE2004/001953

§ 371 (c)(1),
(2), (4) Date: Mar. 3, 2006

(87) PCT Pub. No.: WO2005/023451

PCT Pub. Date: Mar. 17, 2005

(65) Prior Publication Data

US 2006/0283228 A1 Dec. 21, 2006

(30) Foreign Application Priority Data

Sep. 4, 2003 (DE) ..... 203 20 442 U

(51) Int. Cl.
*B21D 22/20* (2006.01)
*B21D 51/44* (2006.01)

(52) U.S. Cl. ..... 72/348; 413/8

(58) Field of Classification Search ..... 72/348, 72/94, 109, 105, 347, 68; 413/23, 8
See application file for complete search history.

(56) References Cited

U.S. PATENT DOCUMENTS

| | | | | | |
|---|---|---|---|---|---|
| 1,671,990 | A | * | 6/1928 | Hammer | 72/94 |
| 1,775,738 | A | * | 9/1930 | Sebell | 72/94 |
| 2,119,662 | A | | 6/1938 | Williams | |
| 3,015,294 | A | * | 1/1962 | Lyon | 29/894.381 |
| 4,567,746 | A | * | 2/1986 | Bachmann et al. | 72/348 |
| 5,211,047 | A | * | 5/1993 | Kaneyuki | 72/313 |
| 5,433,099 | A | * | 7/1995 | Katsuhiro et al. | 72/347 |
| 5,732,581 | A | * | 3/1998 | Kanemitsu et al. | 72/68 |
| 5,740,609 | A | * | 4/1998 | Jurus | 29/894.324 |
| 6,038,910 | A | * | 3/2000 | McClung | 72/348 |

FOREIGN PATENT DOCUMENTS

| | | | |
|---|---|---|---|
| DE | 433 094 | C | 8/1926 |
| DE | 233 036 | A | 2/1986 |
| DE | 692 06 748 | T2 | 1/1992 |
| EP | 0 279 269 | A | 8/1988 |
| EP | 279269 | A2 * | 8/1988 |
| EP | 0 536 952 | A | 4/1993 |

* cited by examiner

*Primary Examiner*—Dana Ross
*Assistant Examiner*—Debra M Sullivan
(74) *Attorney, Agent, or Firm*—Greenblum & Bernstein PLC

(57) ABSTRACT

A method for the production of a cup-shaped article, in particular a blank of a screw cap for glass bottles or the like, from an enameled metal sheet, using two tools in a stepwise manner: 1) the blank is stamped from the metal sheet in a first tool by the relative motion between a cutting bell cooperating with a blank holder and a drawing block, and the blank is drawn around the drawing block, the width of a flange forming between the cutting bell and the blank holder being continuously reduced with a progressive degree of deformation until the flange reaches a defined width (R-r), and 2) the blank is deformed in a second tool such that the radially outwardly directed flange is deflected toward a profiling introduced in a wall of the blank.

3 Claims, 8 Drawing Sheets

METHOD FOR PRODUCING A CUP-SHAPED OBJECT

FIELD OF INVENTION

The invention relates to a method for the stepwise production of a cup-shaped article, in particular a blank of a screw cap for glass bottles or the like, from an enameled metal sheet, whereby in a first step the blank is stamped from the metal sheet by deep-drawing based on the relative motion between a cutting bell cooperating with a blank holder and a drawing block, and the blank is drawn around the drawing block, the width of a flange of the blank forming between the cutting bell and the blank holder being continuously reduced with a progressive degree of deformation.

BACKGROUND DESCRIPTION

Deep drawing is understood to mean the shaping of a sheet metal section (circular blank, plate blank) into a hollow body, or the shaping of a hollow body into a hollow body with a smaller circumference, with or without intentional modification of the sheet metal thickness. During shaping, segments of the blank must be folded up on the cylinder wall, with the parts inbetween being displaced, thus creating radial tensile and tangential compressive stresses. Bending occurs when the cutting bell runs over the blank. The blank holder impinged on by force is provided to prevent the radially outwardly projecting flange from buckling and forming folds under the influence of the tangential compressive stresses.

The caps provided for glass bottles are drawn from relatively thin metal sheets. These sheets, in particular when used in the food industry, are enameled and in many cases have commercial printing. A problem with the cap manufacture is that during shaping in the axially outer region of the cup the enameling cracks and forms fine colored filaments. The cracked enameling does not detract from the appearance, since the axial end of the blank is subsequently rolled in so that the cracked locations, which are also very fine, are not visible on the finished product. However, the colored filaments become lodged not only in the tools but also on the edge of the blank, and a cotton-like texture forms in the tools which must be regularly removed. In addition, the filaments that remain on the cup, in particular on the edge thereof, must be carefully removed so that during filling they do not come into contact with the filling material (foodstuffs), which would be unacceptable.

Caps for glass bottles are mass-produced articles which are manufactured in large quantities in a tool with high cycling times. The cycling times typically have values of approximately 300 $min^{-1}$. To remove the filaments, the manufacturing unit containing the tool must be shut down and blown out or cleaned, thereby lengthening the production time and also increasing the manufacturing costs. The filaments must be blown out very carefully so that the operators of the unit are not subjected to health risks. In addition, the room in which the units are set up must be continually cleaned to remove the colored filaments.

Various methods having stepwise deformation have been developed in the prior art. DD 233 036 A3 discloses a method for deep-drawing sheet metal parts in which a first draw is followed by a second draw within the same press stroke in the same direction, the drawing force of the first draw being employed as a hold-down force by the second draw and being reduced with progressive drawing depth. The hold-down force is progressively reduced from the start of the second draw, and is entirely eliminated before the shaping in the second draw is completed.

In addition, a drawing method for a disk-like metal sheet is known from DE 692 06 748 T2 in which an annular holding element and/or the drawing tool, which have a residual flange region, are moved in such a way that the holding operation is terminated immediately before the drawing stage is completed. The flange region is then drawn while the back end of the flange region is released.

Both methods share the common feature that they are each carried out in a single tool, so that the shaped part remains in this tool during the stepwise deformation. In practical operation, in particular for high cycling times, release of the hold-down force cannot be reliably ensured. For example, for a pneumatically operated unit the response time for the control is too slow to maintain the high cycling time. For this reason, filament or tail formation cannot be ruled out, even during the second process step when the blank holder should not exert any force on the blank to be deformed.

SUMMARY OF THE INVENTION

Proceeding from this problem, the object is to improve the method explained at the outset in such a way that, in particular for high cycling times, filament or tail formation is greatly reduced or even completely eliminated.

This is attained by a method according to the invention in which the production takes place in two tools in a stepwise manner:

1) The blank is stamped from the metal sheet in a first tool by the relative motion between a cutting bell cooperating with a blank holder and a drawing block, and the blank is drawn around the drawing block with impingement of force on the blank holder, the width of a flange forming between the cutting bell and the blank holder being continuously reduced with a progressive degree of deformation until the flange has reached a defined width,
2) The blank is deformed in a second tool so that the radially outwardly directed flange is deflected toward a profiling introduced in a wall of the blank.

The invention is based on the finding that the filament formation results not from the high cutting forces during stamping of the circular blank from the metal sheet, as might be assumed, but rather from the very high surface pressure on the flange, which is formed between the cutting bell and the blank holder, at the end of the deep drawing. Due to the defined width of the flange, the deep drawing or deformation is interrupted shortly before the surface pressure in this flange reaches levels which cause the enamel layer to crack. The cracking of the enamel layer on account of the excessive surface pressure would cause the enamel layer to draw filaments.

The flange then has a maximum width of, e.g., 3 mm, which is very small compared to the height of the cup. The flange is deformed or deflected in a second step in a second tool, without impingement of force on a blank holder, so that no surface pressure acts on the flange during deflection. The necessary shaping force may be kept very low due to the only slight degree of shaping required, thus preventing cracking of the enamel layer and formation of filaments. Introduction of a profiling in the wall of the blank provided in the second step prepares the blank for further processing, such as curling the wall inward.

This method eliminates the shutdown time heretofore necessary for cleaning, and the associated costs, which significantly reduces the manufacturing costs. Since there are no filaments on the blank either, the additional work step and corresponding control steps previously required for removing the filaments are also omitted, which further lowers the manufacturing costs. In addition, tail formation is reduced. Besides the reduction in manufacturing costs, the quality of the product is increased.

An advantageous embodiment of the inventive concept provides that the deformation is carried out by drawing out the flange based on the relative motion between a cutting bell and a drawing block of the second tool.

An alternative embodiment of the method according to the invention provides that the deformation is performed by a guide which cooperates with the second tool. Lastly, a further alternative embodiment of the method according to the invention provides that the deformation is carried out by rolling in a second tool. The rolling renders possible a simple and efficient shaping method in order to prepare the blank for further processing.

The wall preferably is drawn radially outward by the profiling. Alternatively, the profiling causes the wall to deform facing radially inward. These embodiments of the profiling prevent folds or buckles from forming in the wall during a subsequent curling of the wall, which increases the quality of the finished cap. In addition, there is no need to tilt or slide the cap forward later in order to curl the edge.

The radial width of the flange at the end of the first shaping step is less than 3 mm, preferably 0.1-1.5 mm, particularly preferably 0.5-1.0 mm. The smaller the width of the flange, the less force is needed for shaping in the second step. Of course, the width of the flange depends on the surface pressure present, which in turn depends on the material as well as the material thickness or sheet thickness and the compatible maximum value thereof in correlation with the thickness of the colored layer. The optimum width of the flange is iteratively determined in each case for various basic conditions, such as the material, material thickness, and the colored or enameled layer.

DESCRIPTION OF DRAWINGS

The method according to the invention is explained in greater detail by way of example, with reference to the accompanying drawings. They show.

Identical or equivalent components are provided with the same reference numbers in the figures.

DETAILED DESCRIPTION OF EMBODIMENTS OF THE INVENTION

Figure 1:
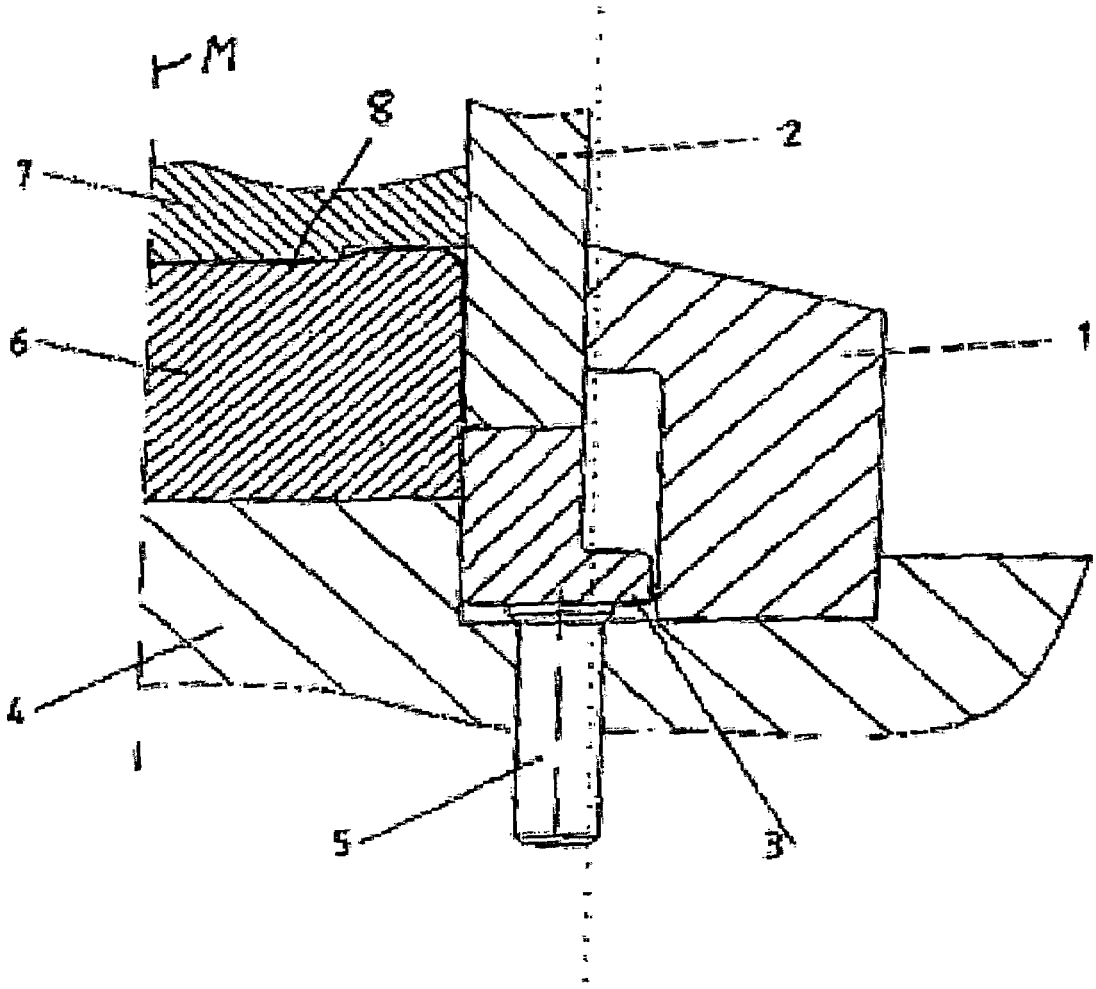
FIG. 1 A partial half section of a first deep-drawing tool.

FIG. 1 shows a partial section of the first deep-drawing tool, symmetrically structured about the centerline M, comprising the cutting ring 1, the cutting bell 2, the blank holder 3 which cooperates with the cutting bell 2, the base 4 which supports the drawing block 6, and the stamping block 7. The stamping block 7 and the drawing block 6 together with the cutting bell 2 enclose the blank 8. The force from a spring assembly (not illustrated here in greater detail) is transmitted to the blank holder 3 via hold-down pins 5 arranged uniformly distributed on a peripheral circle.

Figure 2:
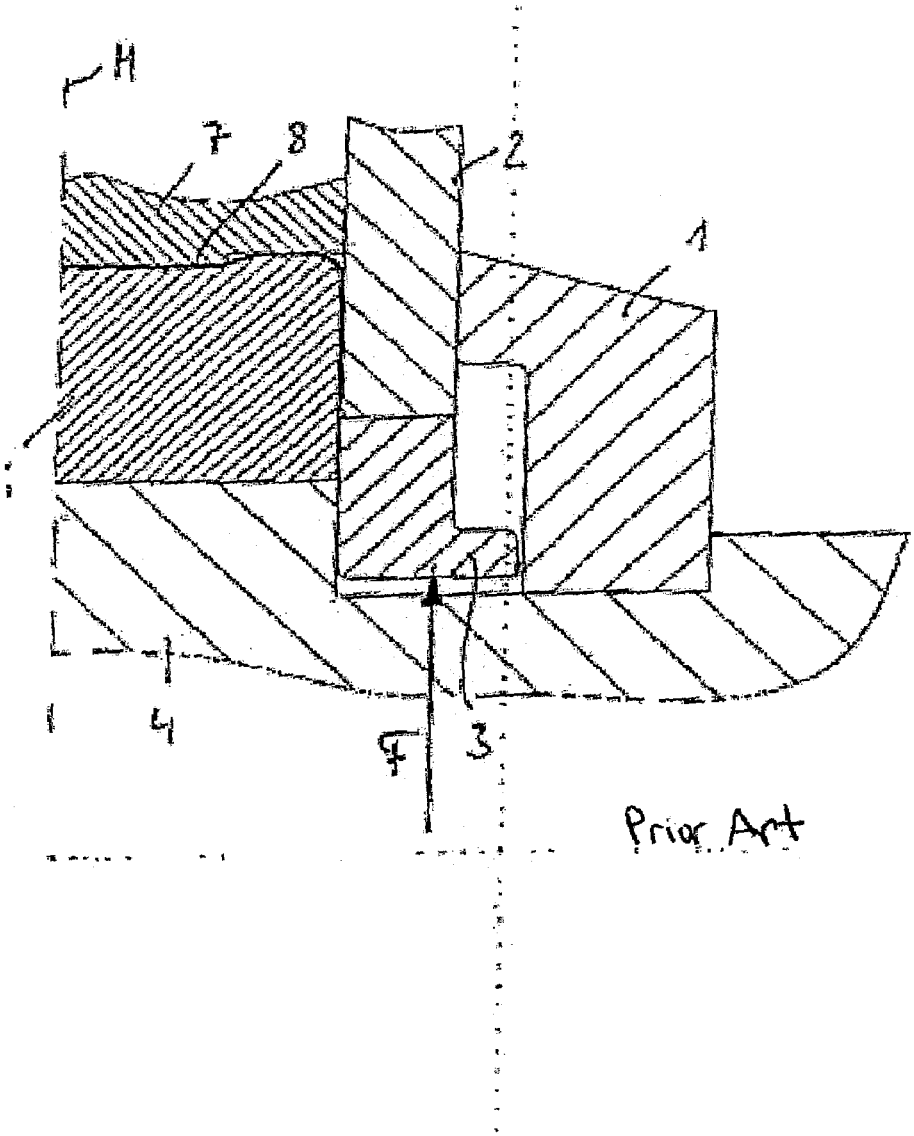
FIG. 2 A deep-drawing tool in partial half section according to the prior art.

The blank 8 is produced according to the prior art using the tool according to FIG. 2, the enameled metal sheet or circular blank cut (stamped) therefrom by the cutting ring 1 being placed on the drawing block 6. The stamping block 7 and the cutting bell 2 are lowered onto the metal sheet, whereby the cutting bell 2 stamps a sheet metal plate from the circular blank. After the metal sheet is separated, a flange is pinched between the blank holder 3 and the cutting bell 2, the width of which flange is continuously reduced in a further lowering motion of the cutting bell 2 and blank holder 3. The reduction in the width of the flange causes the surface pressure in the flange to increase as the result of the force F acting on the blank holder 3.

Figure 3:
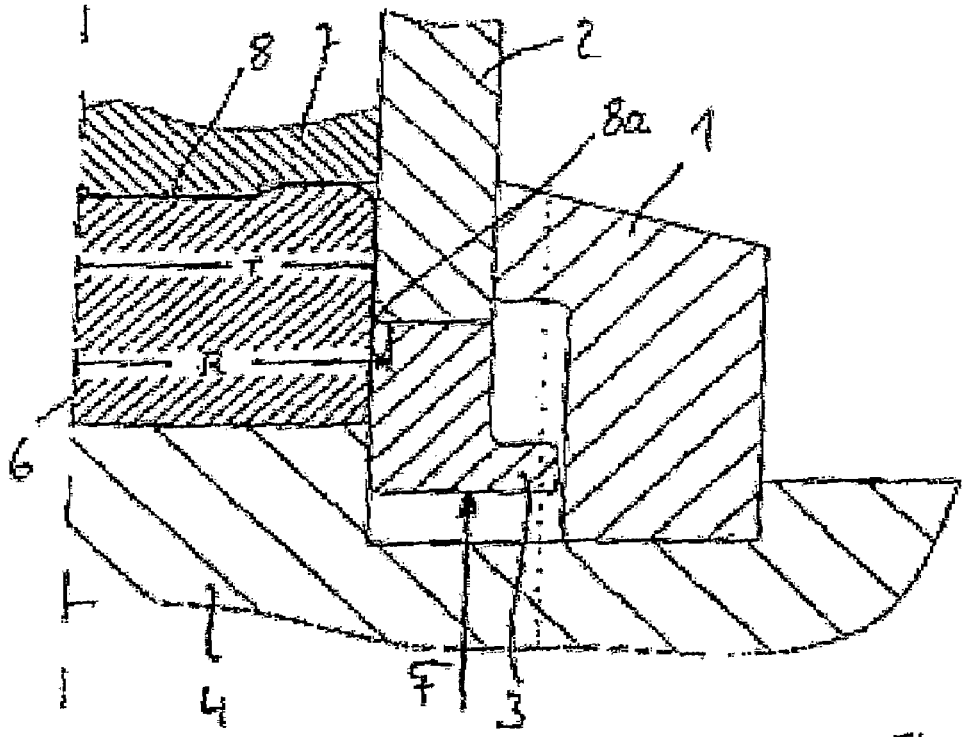
FIG. 3 A first deep-drawing tool in partial half section for carrying out the method according to the invention at the end of the first substep.

FIG. 3 shows the first tool at the end of the first substep of the method according to the invention. The cutting bell 2 and the blank holder 3 are jointly moved in relation to the drawing block 6 until a defined surface pressure develops in the flange 8*a* of the blank 8, i.e., until the width of the flange 8*a* formed by the difference between the outer radius R and the inner radius r has reached a defined dimension. This defined dimension is less than 3 mm, preferably 0.1-1.5 mm, particularly preferably 0.5-1.0 mm. This dimension is thus very small compared to the inner radius r of the blank 8.

The two steps of the deep-drawing method according to the invention are carried out in two different tools. Thus, a conventional first tool may be used in which the blank holder 3 is acted on by force, e.g., via a spring assembly. After the first step is completed, the blank 8 is removed from the first tool and inserted into a different, second tool which either has no blank holder 3, as shown in FIG. 5, or has a blank holder 3 which exerts no force, as shown in FIG. 4.

Figure 4:
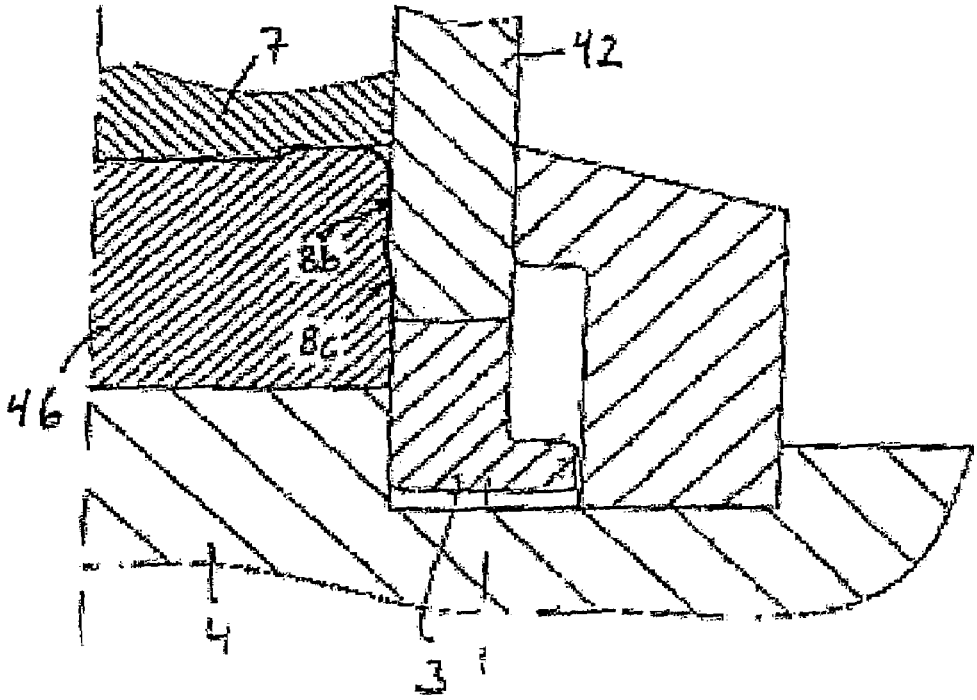
FIG. 4 A second deep-drawing tool in partial half section at the end of the second substep.
Figure 5:
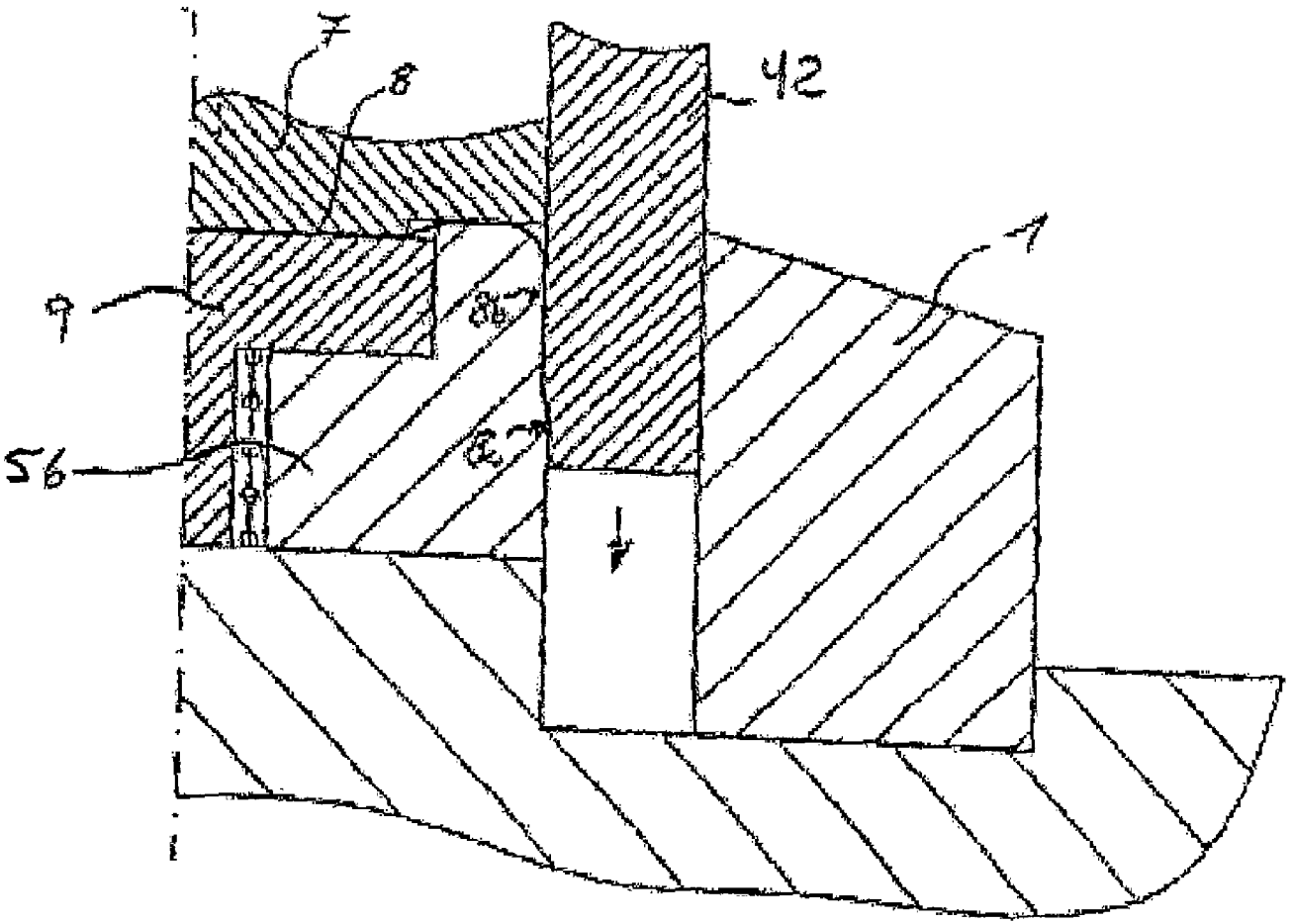
FIG. 5 A further second deep-drawing tool for carrying out the method according to the invention at the end of the second substep, in partial half section.

In the second step shown, e.g., in FIG. 4, in a second tool, the blank holder 3 exerts no force in the deformation, and the cutting bell 42 shapes the blank 8 in a further deep-drawing step. A radially outwardly directed profiling 8*c* is thus introduced at the axial outer end of the wall 8*b*, which profiling 8*c* ensures in the subsequent curling of the wall 8*b* that no folds or buckles develop in the wall 8*b*. The interior of the cutting bell 42 and the exterior of the drawing block 46 have a shape that corresponds to the profiling 8*c*. In the illustrated tool, the blank holder 3 shown in FIG. 4 is used only as a lifter, which then ejects the shaped part upwardly from the tool by a lifting motion after the deformation is completed.

An alternative second tool illustrated with reference to FIG. 5 differs from the tool shown in FIG. 4 in that a blank holder is omitted altogether. An ejecting element 9, integrated into the drawing block 56 as a lifter, is provided instead for lifting or releasing the shaped part, and ejects the shaped part upwardly from the tool by a lifting motion after the deformation is completed. It is also possible to provide an air channel in the drawing block 56 to release the shaped part from the drawing block 56 by an air blast and eject it from the tool.

Figure 6:
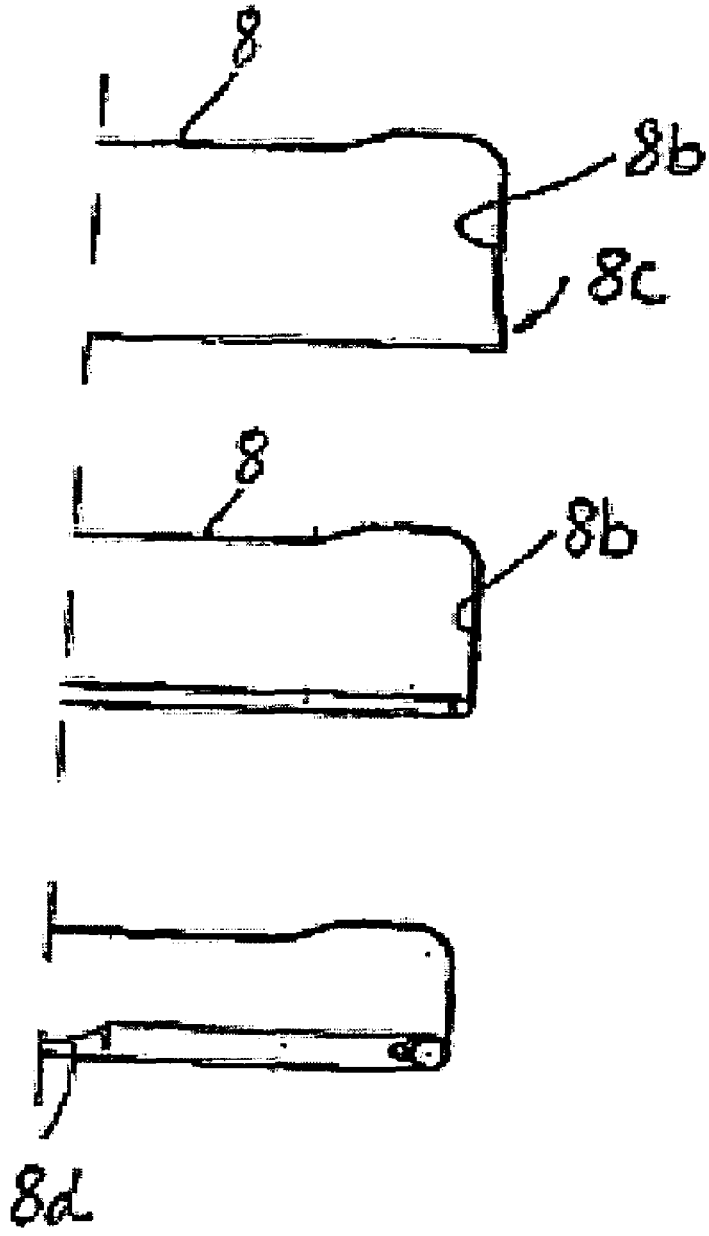
FIG. 6 The diagrammatic representation for further processing of the blank produced according to the invention.

Curling of the wall 8*b* is shown in FIG. 6. The radially inward rolling offsets the radially outwardly directed profiling 8*c*, which causes the wall 8*b* to assume a linear course. The slightly flanged edge is then further curled to increase the stability of the cap. For a screw cap, after the curling is completed, lobes 8*d* uniformly distributed over the circumference are pressed in at the lower edge, which lobes later cooperate with the thread applied to the neck of the glass bottle.

An alternative deformation of the blank 8 in the second substep of the invention is explained below, with reference to FIGS. 7*a* and 7*b*. The blank 8 shaped in the first substep (see FIG. 3) has a radially outwardly directed flange 8*a* in the lower region of the wall 8*b*, and is placed on a shaping block 10. The shaping block 10 has a shoulder 11 on its outer circumference such that the diameter in the lower region 10*a* of the shaping block 10 is smaller than the diameter in the upper region 10*b*. In addition, the shoulder 11 is located essentially in the region of, or at the height of, the flange 8*a* of the blank 8 when the blank is placed on the shaping block 10.

In the deformation presented here, a roller 12 approaches the flange 8*a* of the blank 8 from the outside. The arrow 13 indicates the direction of motion of this approach. The roller 12 rotates about its longitudinal axis 14, which is inwardly inclined at the level of the flange 8*a*. In other words, the lower region of the roller is closer to the shaping block 10 than is the upper region. The rotation about the longitudinal axis 14 is indicated by the curved arrow 15. The roller 12 is guided farther inward until the blank 8 is deflected in the lower region having the flange 8*a*, so that a profiling 8*e* directed radially inward is formed in the wall 8*b*, as shown in FIG. 7*b*. A relative motion between the roller 12 and the shaping block 10 together with the blank 8 thereon, for example, a rotation of the shaping block 10 about its center axis, shapes the profiling 8*e* radially inward along the entire outer circumference of the wall 8*b* of the blank 8.

To allow the blank 8 to be removed or lifted from the shaping block 10, the wall 8*b* together with the profiling 8*e* must be moved radially outward during the upward removal until the inner edge of the profiling 8*e* can be guided past the shoulder 11. It is expedient for the dimensions of the shoulder 11 or the profiling 8*e* to be selected such that this deflection remains in the elastic deformation region of the blank 8. After removal, the wall 8*b* then springs back to the shape produced by the deformation in the second substep.

However, it is also possible for the deflection not to be purely elastic, but rather to be associated with a plastic deformation as well. In that case, however, the dimensions of the shoulder 11 and the profiling 8*e* should be selected such that after the elastic portion of the deflection has returned, the profiling 8*e* is still embodied to be directed sufficiently radially inward. In other words, in this case rolling causes the profiling 8*e* to be inwardly deformed more than is necessary for further processing.

Figure 7A:
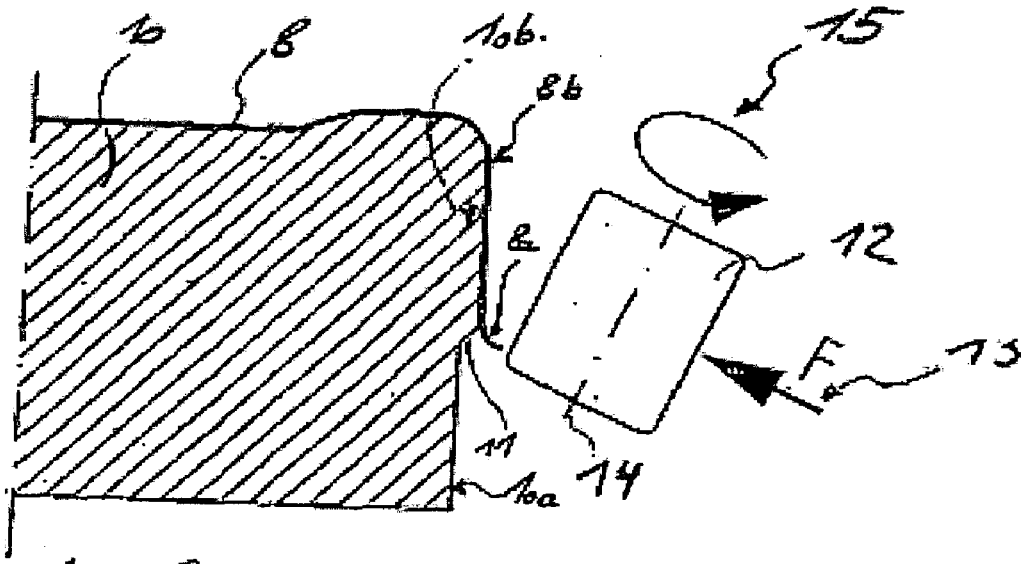
FIG. 7*a* An alternative shaping tool for carrying out the method according to the invention at the start of the second substep, in partial half section.
Figure 7B:
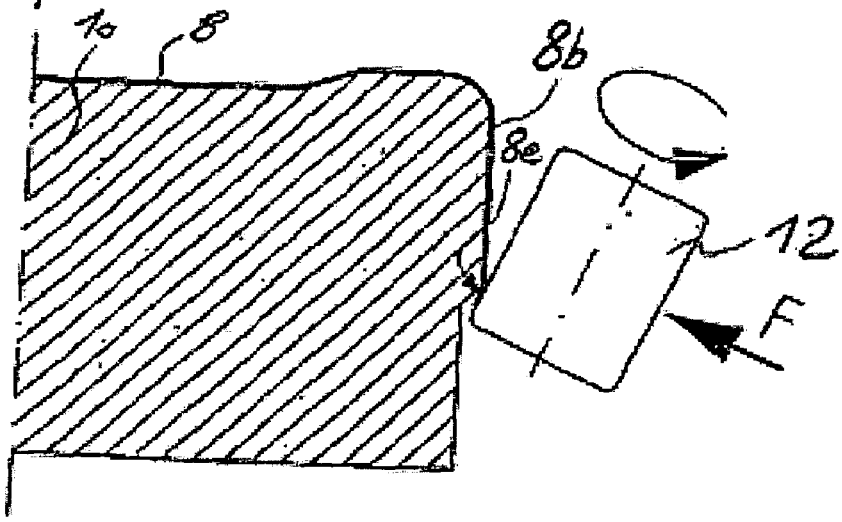
FIG. 7*b* The shaping tool according to FIG. 7*a* at the end of the second substep.
Figure 8:
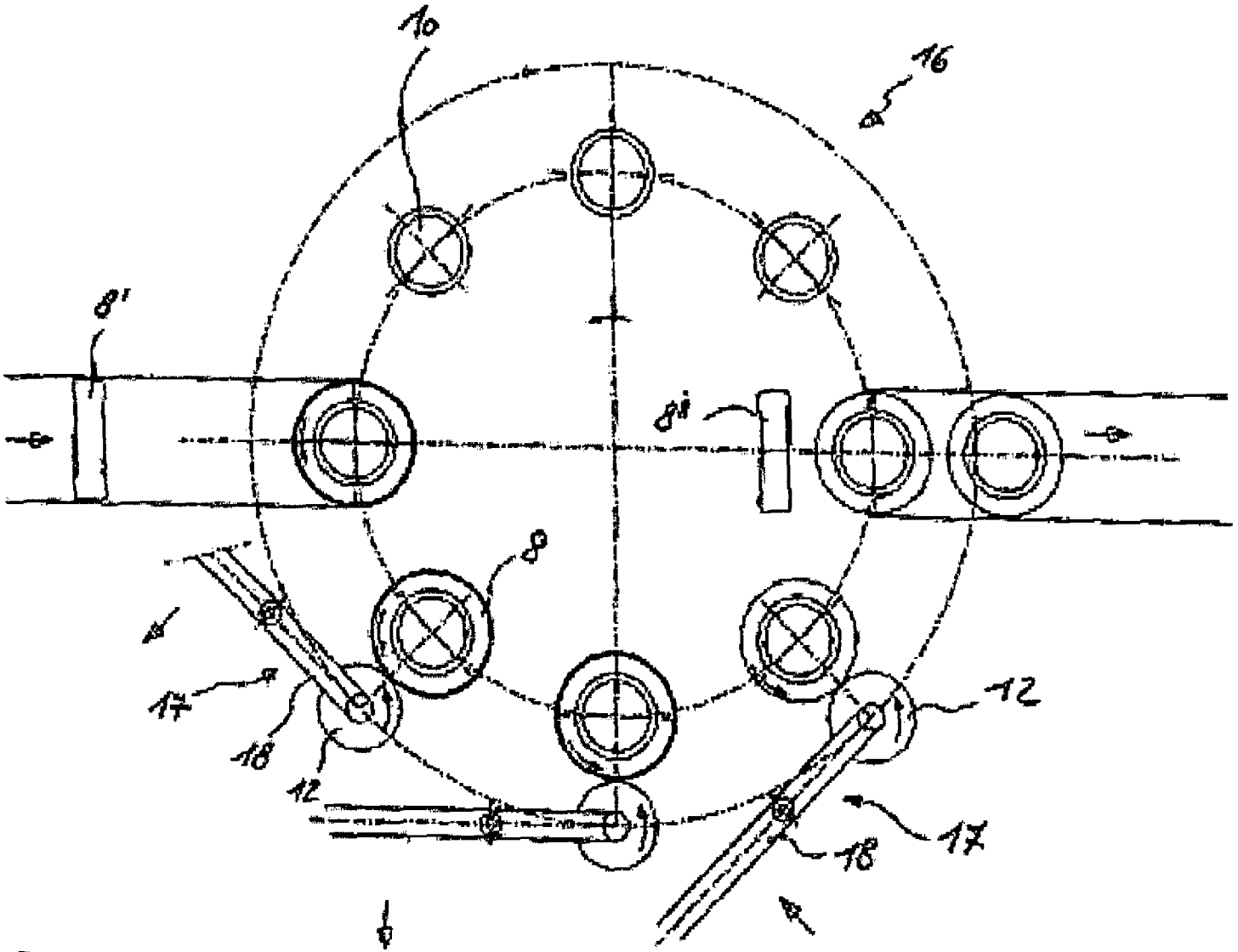
FIG. 8 A top view of the shaping tool from FIG. 7 for carrying out the method according to the invention for the second substep, in partial half section.

FIG. 8 diagrammatically shows a top view of an apparatus 16 having the shaping tool from FIGS. 7*a* and 7*b*. In this example, the apparatus 16 has a total number of eight shaping stations 17 which are situated equidistantly from one another on a circle (indicated by a dashed-dotted line) and which rotate about the center of this circle. Of the eight shaping stations 17, the figure illustrates only the three that are engaged. Each shaping station 17 has a shaping block 10 upon which a blank 8 may be placed. Each shaping station 17 also has a roller 12 which is held by a support arm arrangement 18.

In the illustration in FIG. 8, the blank 8 is supplied to the apparatus 16 from the left and is arranged on the rotating shaping block 10. The blank 8 is shaped by rolling while the apparatus 16 together with all the associated shaping stations 17 rotates in the counterclockwise direction. After a partial rotation of the apparatus 16 by approximately 180°, the blank 8 exits the apparatus 16 to the right in the illustration according to FIG. 8. In the next partial rotation, the shaping block 10 remains unoccupied until it is once again provided with a new blank 8 on the left side of the illustration. During deformation the shaping block 10 occupied by a blank 8 is rotated about its longitudinal axis, which is perpendicular to the plane of the drawing. In this manner the blank 8 is provided with the profiling according to the invention along its entire outer circumference. By way of clarification, the figure respectively shows a cross section through the blank 8' before shaping and through the blank 8" after shaping.

Figure 9:
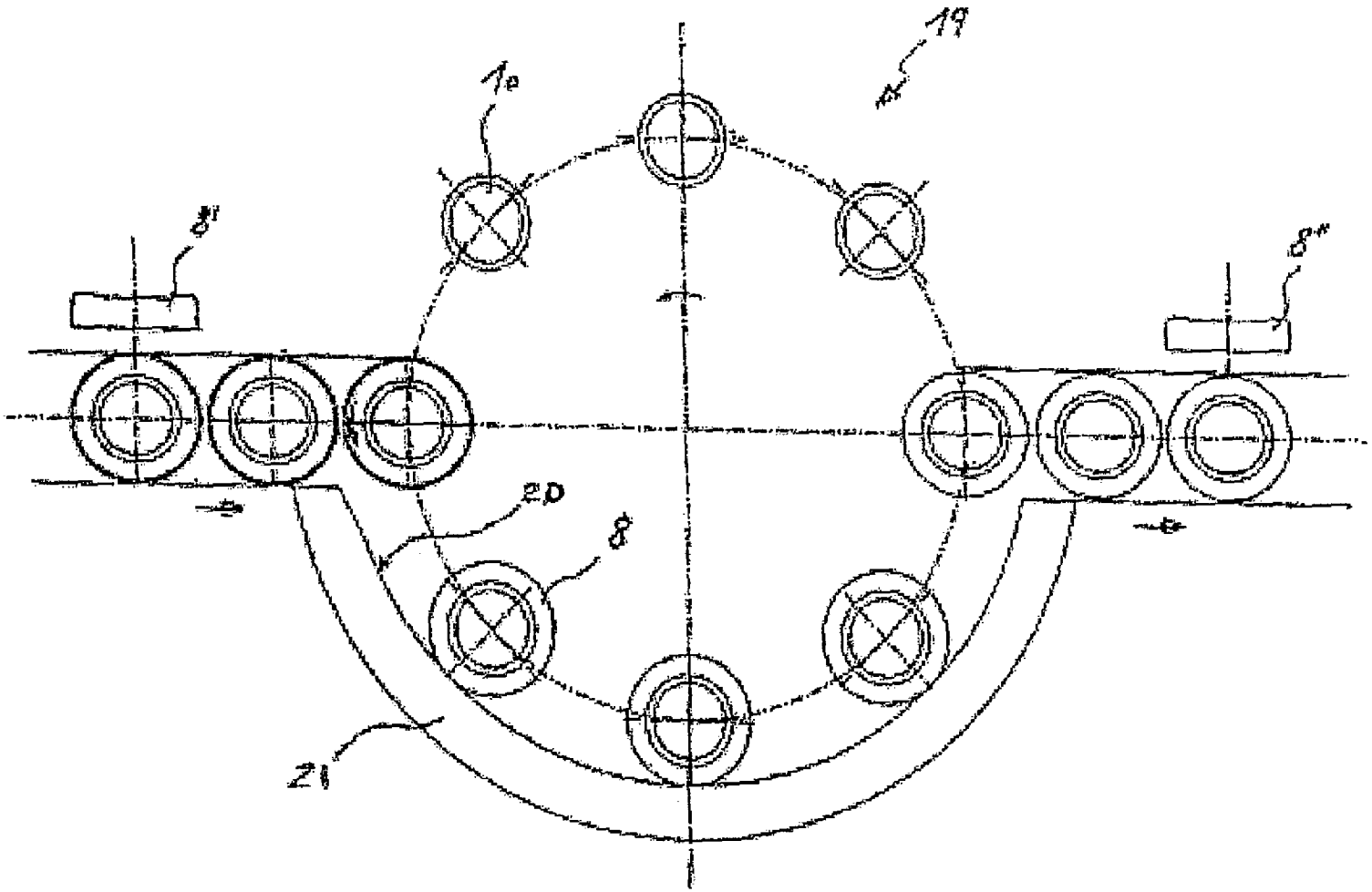
FIG. 9 A top view of an alternative shaping tool for carrying out the method according to the invention for the second substep, in partial half section.

Lastly, FIG. 9 shows a further apparatus 19 for carrying out the deformation according to the invention in the second substep. The apparatus has a total number of eight shaping blocks 10 which are arranged equidistantly from one another on a circle and which rotate about their common center axis in the counterclockwise direction. Furthermore, each shaping block 10 also rotates about its longitudinal axis, which is perpendicular to the plane of the drawing. As with the apparatus 16 already illustrated in FIG. 8, the blank 8 is likewise supplied to the apparatus 19 from the left side (based on the illustration in the drawing) and is discharged from it after the apparatus 19 has made a partial rotation of approximately 180°.

During the partial rotation, the blank together with the flange 8*a* located on the wall 8*b* is brought into contact with an inner surface 20 of a rigid guide 21 which has essentially a semicircular shape. It is not clearly shown in the figure that the radius of the semicircle tapers in order to continuously further deform the blank 8 in contact with the inner surface 20, so that the blank has an inwardly directed profiling 8*e* when discharged from the apparatus 19, as is also produced by the apparatus shown in FIG. 8.

For the deformations in the second substep presented here, all of the alternative procedures share the common feature that the deforming force is not opposed by a force or counterforce applied to the blank 8 from outside. The cutting bell 2 exerts only a downward perpendicular force on the blank 8 during the drawing (see FIGS. 4 and 5). For the deformation by a roller 12 or a guide 21 (see FIGS. 8 and 9), the blank 8 is acted on only by a force from radially outward and downward. A counterforce, such as that exerted by the blank holder in the first substep, does not act on the blank in the second substep.

The invention claimed is:

1. A method for the production of a cup-shaped article, from an enameled metal sheet, stepwise in two tools comprising:

stamping a blank from the metal sheet in a first tool by a relative motion between a cutting bell cooperating with a blank holder and a drawing block, and the blank is drawn around the drawing block with impingement of force on the blank holder, a width of a flange forming between the cutting bell and the blank holder being continuously reduced with a progressive degree of deformation until the flange has reached a defined width R-r while still remaining pinched between the cuffing bell and blank holder, wherein R is an outer radius of the blank including the flange and r is an inner radius of the blank which does not include the flange, and deforming the blank in a second tool without impingement of force on any blank holder acting on the flange while the flange is deflected toward a profiling introduced in a wall of the blank, wherein the radial width R-r of the flange is essentially less than 3 millimeters.

2. The method according to claim 1, wherein the radial width R-r is 0.1-1.5 mm.

3. The method according to claim 2, wherein the radial width R-r is 0.5-1.0 mm.

* * * * *